US007407693B2

(12) United States Patent
Anderson

(10) Patent No.: US 7,407,693 B2
(45) Date of Patent: Aug. 5, 2008

(54) ORNAMENTAL DEVICE

(76) Inventor: Scott Anderson, 133 Darwin St., Lake Geneva, WI (US) 53147

( * ) Notice: Subject to any disclaimer, the term of this patent is extended or adjusted under 35 U.S.C. 154(b) by 96 days.

(21) Appl. No.: 11/023,188

(22) Filed: Dec. 27, 2004

(65) Prior Publication Data

US 2006/0141174 A1 Jun. 29, 2006

(51) Int. Cl.
*A47G 33/04* (2006.01)

(52) U.S. Cl. ..... 428/7; 428/544; 428/542.2

(58) Field of Classification Search ..... 428/7, 428/544, 542.2
See application file for complete search history.

(56) References Cited

U.S. PATENT DOCUMENTS

| | | | | |
|---|---|---|---|---|
| 2,111,109 | A | 3/1938 | Bolyard | |
| D130,937 | S | 11/1941 | Dennison | |
| 2,651,130 | A * | 9/1953 | Stratmann, Jr. | 428/7 |
| 4,186,503 | A | 2/1980 | Fontana | |
| 4,286,780 | A | 9/1981 | Vermeire | |
| 4,380,562 | A | 4/1983 | Bream | |
| 4,428,988 | A | 1/1984 | Adinamis | |
| 4,578,291 | A | 3/1986 | Miner | |
| 5,255,457 | A * | 10/1993 | Lipson | 40/744 |
| 6,258,420 | B1 * | 7/2001 | Lehman | 428/7 |
| D472,183 | S | 3/2003 | Flohe | |
| 6,746,303 | B2 * | 6/2004 | Beidokhti | 446/374 |
| 6,783,815 | B2 | 8/2004 | Flohe | |
| 2004/0154368 | A1 | 8/2004 | Flohe | |

* cited by examiner

*Primary Examiner*—Jane Rhee
(74) *Attorney, Agent, or Firm*—Jasson Shupe & Munger Ltd.

(57) ABSTRACT

The ornamental device comprises a unitary body having a spine and a plurality of arms extending from the spine, each of the arms having a free end. The spine and at least one arm are selectively bendable at any point along their lengths. The spine is bendable rotationally and sideways. In certain desired embodiments, the ornamental device is selectively bendable at any point along the length of each arm. Most desirable in where the ornamental device is bendable into a configuration having each arm resting in a different plane. Also desirable is an embodiment that finds the device bendable into a configuration substantially planar.

10 Claims, 3 Drawing Sheets

ORNAMENTAL DEVICE

FIELD OF THE INVENTION

This invention relates to decorative devices, and more particularly to decorative devices adapted for transformation into a number of different figures both two and three-dimensional.

BACKGROUND OF THE INVENTION

Various decorative objects have been created from thin sheet-like material. Such objects have included illusion-producing devices and Christmas tree ornaments.

Three-dimensional ornamental devices described in U.S. Pat. Nos. 6,783,815, D472,183 and U.S. application Ser. No. 10/749,603 disclose objects having a series of elongate strips with both ends connected to a spine member having a single vertical axis. These devices are each adapted to rotate about the axis of the spine member. None permit their spines to be bent laterally away from its vertical axis.

U.S. Pat. No. 4,286,780 (Vermeire) discloses another three-dimensional decorative device with a plurality of fins on its center strip portion. Similar to the devices described above, the Vermeire device is adapted to give the appearance of an axially moving, sinusoidal, optical wave pattern when rotated. Consequently, the axis of the central strip is maintained substantially vertical to achieve full rotation. This does not allow the central strip to be bent laterally away from its vertical axis. Moreover, the Vermeire device is fabricated from a louvered material such as thin aluminum sheet. Although the final shape of the device is produced by twisting the central strip about its vertical axis, the strip loses about one half of its twists when the twisting force is released because of resilience in the material used.

There are other decorative structures having a series of horizontal slats on a vertical axis. Such structures are disclosed in U.S. Pat. Nos. 4,578,291, 4,428,988, 4,186,503, 4,380,562, D130,937 and 2,111,109. However, all of these structures are assembled from a number of separate elements, namely, horizontal slat-like members removably secured to a vertical member with an axis that is maintained in its vertical orientation.

OBJECTS OF THE INVENTION

It is an object of the invention to provide an improved ornamental device overcoming some of the problems and shortcomings of the prior art, including those referred to above.

Another object of the invention is to provide an ornamental device which from its initial shape can be transformed into a number of different configurations by bending any of its elements in any desired direction so the ornament can remain substantially planar or have each element in a different plane.

Yet another object of the invention is to provide an ornamental device made from a non-resilient material allowing any element of the ornament to be deformed and then stay in that desired position until specifically changed.

Still another object of the invention is to provide an ornamental device with all its elements being portions of a single unitary piece.

How these and other objects are accomplished will become apparent from the following descriptions and the drawings.

SUMMARY OF THE INVENTION

This invention, which will be described in detail below, is an improvement in ornamental devices of the type having a plurality of arms secured on a spine.

The present invention provides an ornamental device formed from a flexible, non-resilient material, preferably a thin sheet metal. The term "flexible," as used herein, means that the material forming the body of the device can be easily bent at any point of the body in any desired direction to achieve a number of different configurations. The term "non-resilient," as used in reference to the material forming the body of the device means that such material permits selective bending and stays in a given position until specifically changed.

The inventive ornamental device comprises a unitary body having a spine and a plurality of arms extending from the spine, each of the arms having a free end. The spine and at least one arm are selectively bendable at any point along their lengths. In certain desired embodiments, the ornamental device is selectively bendable at any point along the length of each arm. Most desirable is where the ornamental device is bendable into a configuration having each arm resting in a different plane. A most desirable embodiment finds the device bendable into a configuration substantially planar.

In highly preferred embodiments, an initial configuration of the ornamental device finds the spine substantially linear, wherein a number of different configurations can be achieved by substantially bending the spine laterally in any direction away from it initial axis.

In certain preferred embodiments, the spine may be selectively twisted. The term "selectively twisted" as used herein means bending of the spine at a selected point of its length by turning the two portions of the spine adjacent to that point in opposite rotational directions.

In some preferred embodiments the ornamental device has a rounded element at the free end of each arm.

One most desirable embodiment finds the ornamental device including a hanging means preferably formed by bending one arm into a loop.

DETAILED DESCRIPTION OF PREFERRED EMBODIMENTS

Figure 1:
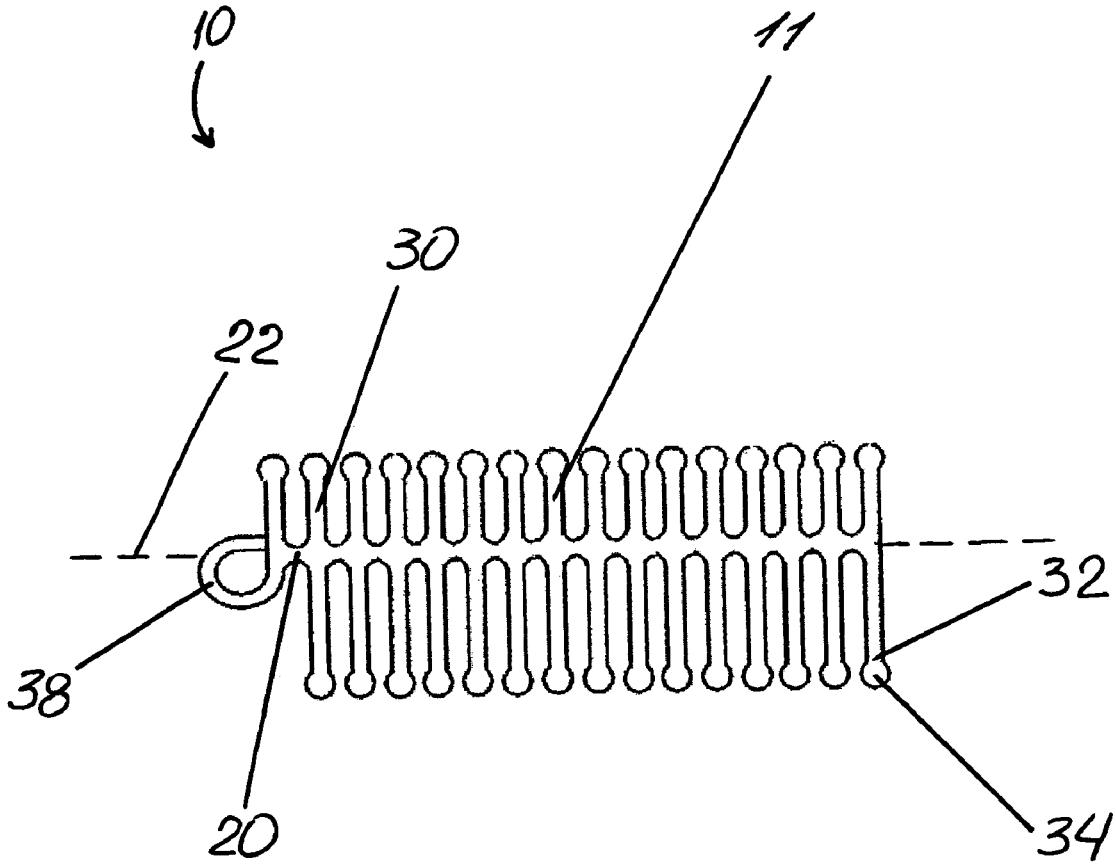
FIG. 1 is a plan view of a preferred ornamental device in accordance with this invention depicting its initial substantially planar configuration.

Referring to FIGS. 1-5, an ornamental device 10 is shown having a monolithic body 11 with plasticity made from a flexible, non-resilient material. Body 11 includes a spine 20 and a plurality of arms 30 extending from spine 20, each arm 30 having a free end 32. Preferably, each arm 30 has a rounded element 34 at its free end 32.

As shown on FIG. 1, ornamental device 10 has a hanging means 38 formed by bending one of the arms 30 into a loop.

FIG. 1 illustrates body 11 in its initial substantially planar configuration having spine 20 collinear along a straight line 22.

Figure 2:
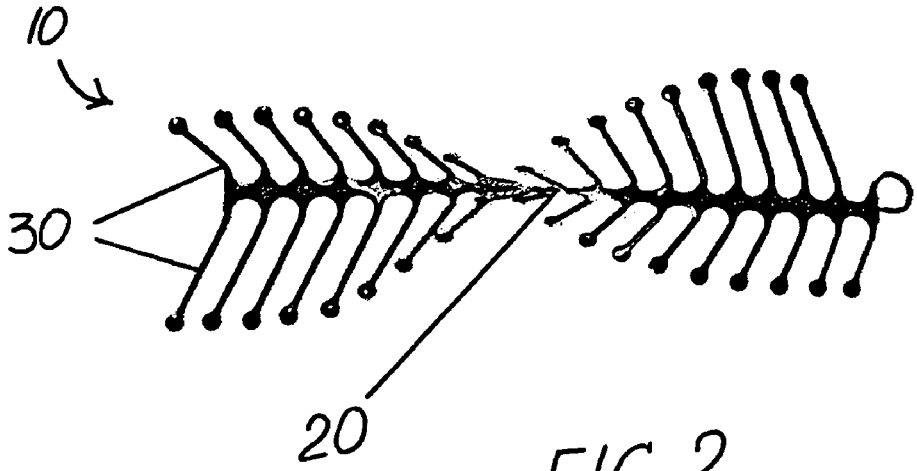
FIG. 2 is a perspective view of the device of FIG. 1 depicting selective twisting of its spine.
Figure 3:
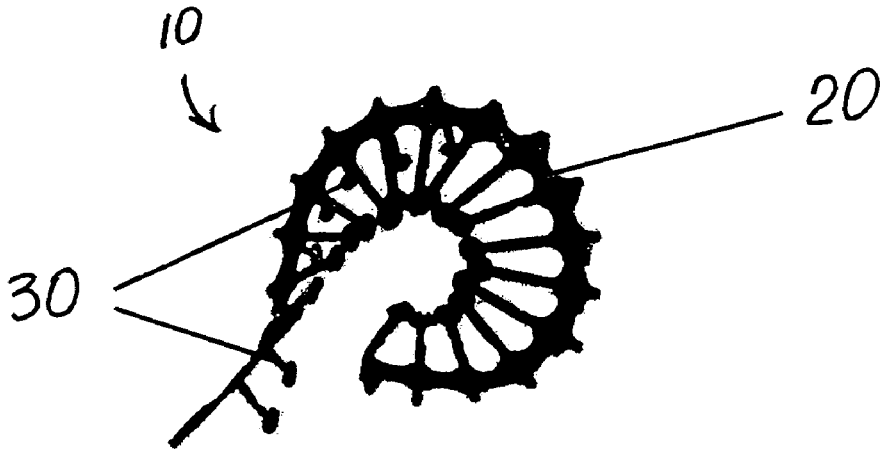
FIG. 3 is a perspective view of the device of FIG. 1 having each arm positioned in a different plane.
Figure 4:
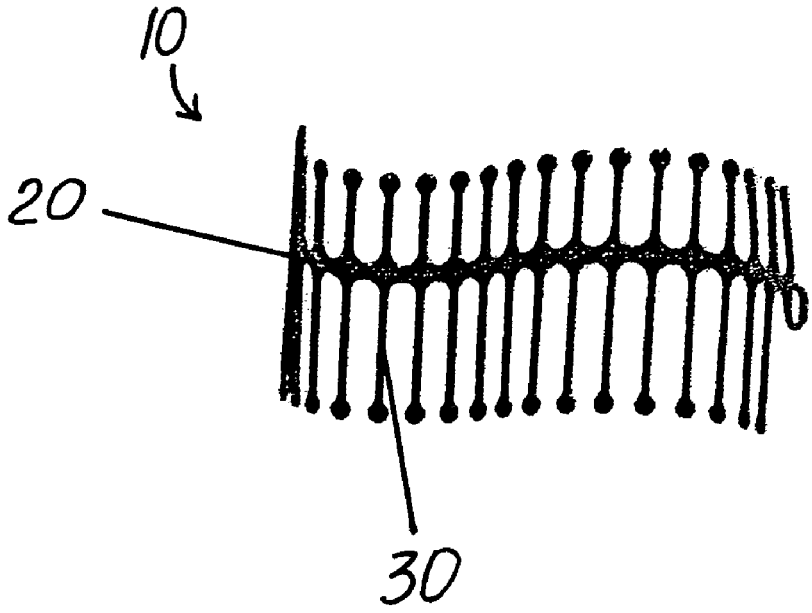
FIG. 4 is a perspective view of the ornamental device illustrating a three-dimensional configuration achieved by selective bending of the spine laterally away from the straight line of its initial configuration in FIG. 1.

FIGS. 2-4 illustrate possible variants of three-dimensional configurations of ornamental device 10 achieved by selective bending of spine 20 and/or arms 30.

Referring to FIG. 2, a three-dimensional configuration is formed by selective bending of arms 30 to position each of the arms 30 in a different plane and then selective twisting of spine 20.

Referring to FIG. 3, a three-dimensional configuration is formed by selective bending of arms 30 to position each of the arms 30 in a different plane and then selectively bending spine 20 into a curve.

Referring to FIG. 4, shown configuration is formed by selective bending of spine 20 laterally away from straight line 22 forming a wave-like configuration.

Figure 5:
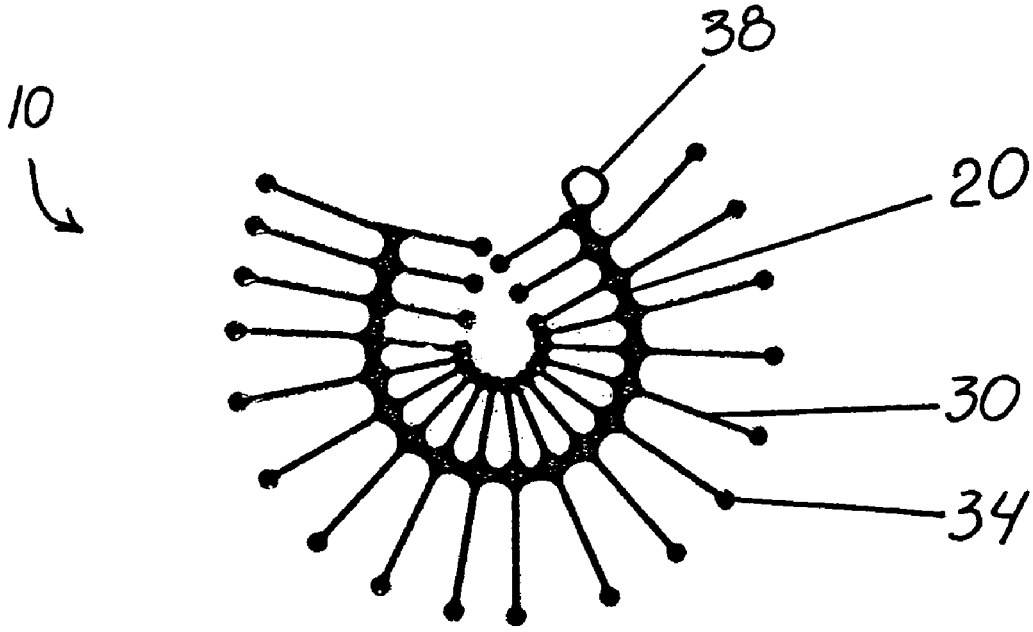
FIG. 5 is a plan view of the ornamental device illustrating a configuration achieved by bending the spine laterally within the same plane of its initial form of FIG. 1.

FIG. 5 illustrates substantially planar configuration of device 10 having a circular snowflake-like appearance achieved by selectively bending spine 20 laterally away from straight line 22 but within the same plane as initial configuration shown on FIG. 1.

While the principles of the invention have been shown and described in connection with specific embodiments, it is to be understood that such embodiments are by way of example and are not limiting.

The invention claimed is:

1. An ornamental device consisting of a single piece of flexible non-resilient material defining a unitary body, the body having an elongated spine portion extending longitudinally from a first end to a second end and a plurality of monolithic arm portions spaced apart from each other, each of the arm portions being integrally and directly attached to the spine portion at a point of attachment, once projecting from the spine portion and terminating at a free end, the points of attachment extending uniformly from the first end to the second end, the spine portion and each of the arm portions having a length, whereby the spine portion and at least one arm portion are selectively bendable at any point along the length thereof, wherein the arms define a plurality of arm pairs, each arm pair having a first arm pair having a first arm with a first length and a second arm with a second length, each first arm being opposite to the corresponding second arm, wherein all the first arms are located on one side of the spine and all the second arms are located on the opposite side of the spine wherein all the first lengths are substantially equal and all the second lengths are substantially equal, the second lengths being greater than the first lengths.

2. The ornamental device of claim 1 wherein the flexible, non-resilient material is a thin sheet metal.

3. The ornamental device of claim 2 wherein the device is selectively bendable at any point along the length of each arm.

4. The ornamental device of claim 3 wherein the device is bendable into a configuration wherein each arm is in a different plane.

5. The ornamental device of claim 3 wherein the device is bendable into a substantially planar configuration.

6. The ornamental device of claim 1 wherein the spine maybe selectively twisted.

7. The ornamental device of claim 1 wherein the device has an initial configuration having the spine positioned on a straight line, and a plurality of configurations achieved by bending the spine laterally away from the straight line.

8. The ornamental device of claim 1 wherein the free end of each arm includes a rounded element.

9. The ornamental device of claim 1 includes a hanging means.

10. The ornamental device of claim 9 wherein the hanging means is formed by bending one arm into a loop.

* * * * *